US008183964B2

(12) United States Patent
Mrowiec et al.

(10) Patent No.: US 8,183,964 B2
(45) **Date of Patent: *May 22, 2012**

(54) CURRENT TRIP UNIT FOR CIRCUIT BREAKER

(75) Inventors: Jacek Mrowiec, Slaskie (PL); Dominik Banaszczyzyk, Slaskie (PL); Pawel Lazarczyk, Slaskie (PL)

(73) Assignee: General Electric Company, Schenectady, NY (US)

( * ) Notice: Subject to any disclaimer, the term of this patent is extended or adjusted under 35 U.S.C. 154(b) by 433 days.

This patent is subject to a terminal disclaimer.

(21) Appl. No.: 12/378,630

(22) Filed: Feb. 18, 2009

(65) Prior Publication Data

US 2009/0153276 A1 Jun. 18, 2009

Related U.S. Application Data

(63) Continuation of application No. 11/642,172, filed on Dec. 20, 2006, now Pat. No. 7,515,025.

(51) Int. Cl.
*H01H 9/20* (2006.01)
*H01H 9/00* (2006.01)

(52) U.S. Cl. ..... 335/167; 335/172

(58) Field of Classification Search ..... 335/119, 335/177, 180, 126, 18, 38, 167–172
See application file for complete search history.

(56) References Cited

U.S. PATENT DOCUMENTS

| | | | | | |
|---|---|---|---|---|---|
| 1,988,287 | A | * | 1/1935 | Thumim | 335/24 |
| 2,436,354 | A | | 2/1948 | Burke et al. | 335/230 |
| 2,462,566 | A | | 2/1949 | Smith | 200/56 R |
| 2,980,857 | A | | 4/1961 | Langford | 324/150 |
| 3,056,868 | A | | 10/1962 | Jacobson | 335/153 |
| 3,218,523 | A | * | 11/1965 | Benson | 335/234 |
| 3,634,795 | A | * | 1/1972 | Schleicher | 335/170 |
| 3,914,723 | A | * | 10/1975 | Goodbar | 335/79 |
| 4,197,518 | A | * | 4/1980 | Seilly et al. | 335/126 |
| 4,378,543 | A | * | 3/1983 | Melter et al. | 335/186 |
| 4,628,289 | A | * | 12/1986 | Huber | 335/168 |

(Continued)

FOREIGN PATENT DOCUMENTS

| | | | |
|---|---|---|---|
| CH | 155907 | A | 7/1932 |

(Continued)

OTHER PUBLICATIONS

Extended European Search Report dated Feb. 10, 2009 in the corresponding European Application No. 07123168.2.

*Primary Examiner* — Lincoln Donovan
*Assistant Examiner* — Alexander Talpalatskiy
(74) *Attorney, Agent, or Firm* — Ohlandt, Greeley, Ruggiero & Perle, L.L.P.

(57) ABSTRACT

A trip unit having a current carrying element, an anchor having an up and a down position, and an oscillator having a first position and a second position. The oscillator in the first position permits the anchor to move into the down position, and the oscillator in the second position blocks the anchor from moving into the down position. Additionally, a magnetic yoke surrounds the current carrying element and the anchor. A magnetic flux flowing through the magnetic yoke moves the anchor into the down position. A magnetic yoke surrounding the current carrying element and the oscillator provides a magnetic flux flowing through the magnetic yoke moves the oscillator into the first position, or into the second position.

17 Claims, 3 Drawing Sheets

U.S. PATENT DOCUMENTS

| | | | | | |
|---|---|---|---|---|---|
| 4,710,739 | A | * | 12/1987 | Heyne et al. | 335/174 |
| 4,855,699 | A | * | 8/1989 | Hoegh | 335/177 |
| 5,144,516 | A | * | 9/1992 | Sham | 361/49 |
| RE34,396 | E | * | 10/1993 | Wollenhaupt | 200/50.06 |
| 5,300,905 | A | * | 4/1994 | Kolbas et al. | 335/167 |
| 5,867,081 | A | | 2/1999 | Arnoux et al. | 335/177 |
| 5,883,557 | A | * | 3/1999 | Pawlak et al. | 335/179 |
| 5,933,063 | A | * | 8/1999 | Keung et al. | 335/18 |
| 6,388,859 | B1 | * | 5/2002 | Turner et al. | 361/115 |
| 6,424,244 | B1 | * | 7/2002 | Hendel | 335/177 |
| 6,921,873 | B2 | | 7/2005 | Puskar et al. | 200/321 |
| 6,980,069 | B2 | | 12/2005 | O'Keeffe et al. | 335/35 |

FOREIGN PATENT DOCUMENTS

| | | | |
|---|---|---|---|
| DE | 493280 | C | 3/1930 |
| DE | 19715114 | A1 | 10/1998 |
| JP | 2043705 | | 2/1990 |

* cited by examiner

CURRENT TRIP UNIT FOR CIRCUIT BREAKER

CROSS REFERENCE TO RELATED APPLICATIONS

This application is a continuation of application Ser. No. 11/642,172 U.S. Pat. No. 7,515,025, which was filed Dec. 20, 2006 and issued Apr. 7, 2009, the entire contents of all of which are incorporated herein by reference.

BACKGROUND

1. Field of the Invention

The present disclosure relates generally to circuit breakers and, more particularly, the present disclosure relates to a current trip unit for a circuit breaker.

2. Description of the Related Art

Direct current fast switches serve to supervise the electrical current influx by a leader and to actuate a switch if a current threshold value is exceeded, for example, in a short circuit current. Typically, a warning is issued or the circuit is interrupted.

Conventional over-current breakers or tripping units have a magnetic yoke that surrounds a current-carrying leader. The magnetic yoke has anchors that are movable along an axis and the anchors are prevented from moving downward by a spring on the axis in a resting position. A magnetic flow through the magnetic yoke affects the anchor and forces the anchor against the resistance of the spring. If the current flowing through the leader exceeds a certain value, the magnetic force acting on the anchor is greater than the spring power of the spring. Thus, the anchor is pulled downward toward the magnetic yoke and correspondingly a trigger can be actuated to interrupt the circuit.

Conventional tripping units are bi-directional, which means that conventional units are not current direction sensitive. This conventional style of tripping is suitable in line feeder breakers. But in direct current systems there is also need to have a rectifier breaker, to protect a rectifier. A bi-directional tripping unit can not be used in a rectifier breaker to protect a rectifier. A rectifier is a current component of a circuit that allows current to pass in one direction yet blocks the flow of current in the other direction. It can be considered as a source of direct current. In fault conditions of a rectifier, a reverse current can appear in direction opposite to normal output of a rectifier. A rectifier breaker is a current component of a circuit that protects the rectifier in case of said fault of rectifier. For this reason, a conventional bi-directional unit cannot be used in a rectifier breaker, and a separate reverse current tripping device must be used with the bi-directional trip unit.

Accordingly, there is a need for a trip unit for a circuit breaker, which has the capacity to still provide circuit protection and function as a rectifier.

SUMMARY

The present disclosure provides a trip unit having a current leading element, an anchor having an up and a down position, and an oscillator having a first position and a second position. The oscillator in the first position permits the anchor to move into the down position, and the oscillator in the second position blocks the anchor from moving into the down position. Additionally, a magnetic yoke surrounds the current leading element and the anchor. A magnetic flux flowing through the magnetic yoke moves the anchor into the down position. A magnetic yoke surrounding the current leading element and the oscillator provides a magnetic flux flowing through the magnetic yoke moves the oscillator into the first position, or into the second position.

The present disclosure further provides trip unit having a movable anchor having a tripped position and an untripped position. An oscillator having a first and second position prevents movement of the anchor into the tripped position when the oscillator is in the second position, and allows the anchor to move into the tripped position when the oscillator is in the first position. A magnetic yoke surrounds the movable anchor and the oscillator and the magnetic yoke provides a magnetic current to move the movable anchor into the tripped position, and the magnetic yoke provides a magnetic current to move the oscillator into the first and second positions.

The above-described and other features and advantages of the present disclosure will be appreciated and understood by those skilled in the art from the following detailed description, drawings, and appended claims.

BRIEF DESCRIPTION OF THE DRAWINGS

These and other objects of the present disclosure will be more apparent from the following detailed description of the present disclosure, in conjunction with the accompanying drawings wherein.

DETAILED DESCRIPTION OF THE PREFERRED EMBODIMENT

Figure 1:
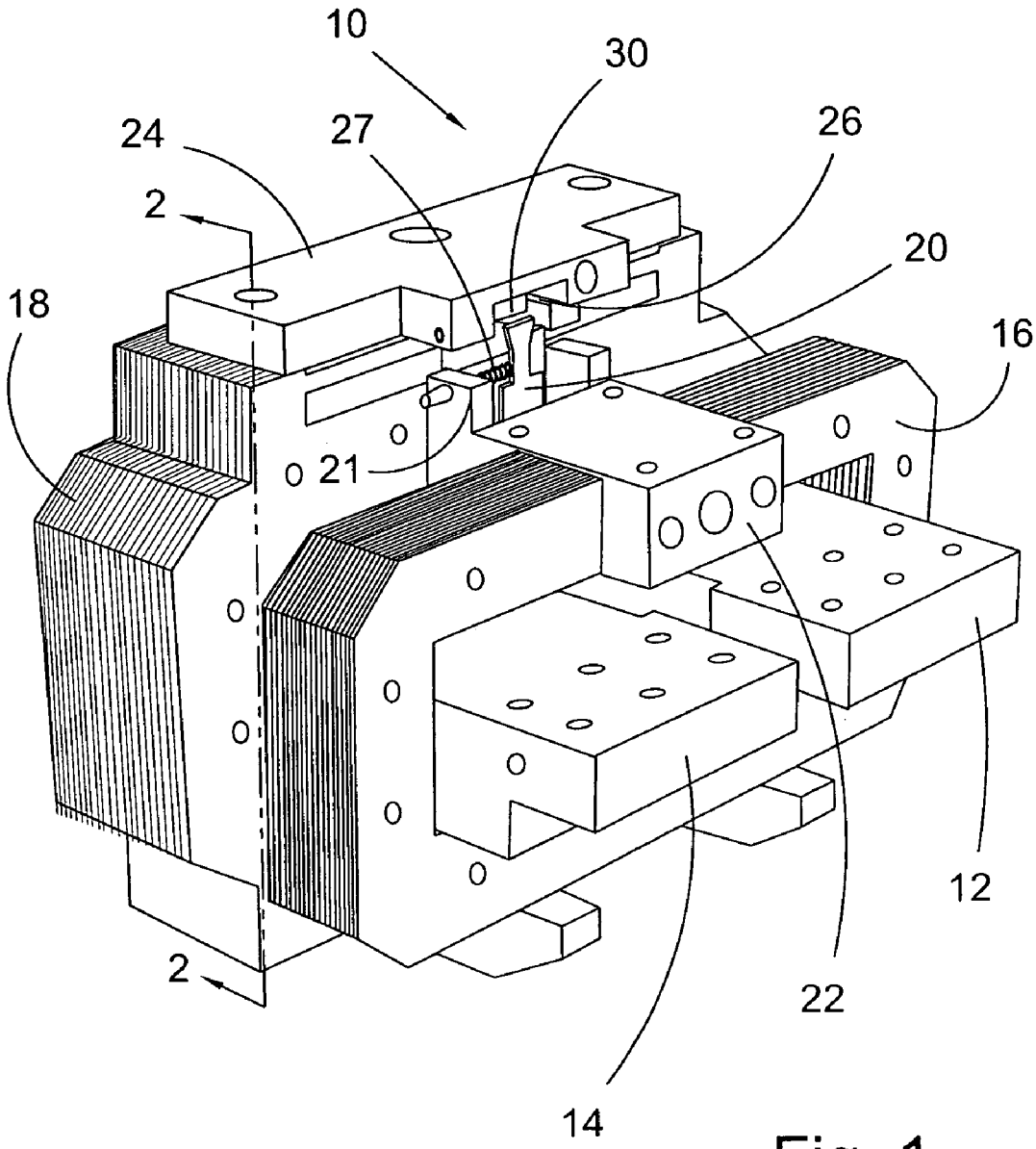
FIG. 1 is a perspective view of an exemplary embodiment of the trip unit of the present disclosure.

Referring now to the figures and in particular to FIGS. 1-5, an exemplary embodiment of a current trip unit for a circuit breaker according to the present disclosure is shown and is generally referred to by reference numeral 10. Current flowing through trip unit 10 is typically direct current. Trip unit 10, advantageously, includes a blockade latch 20 that can rotate to prevent trip unit 10 from tripping when current is flowing through current leading elements 12 and 14 in a predefined forward direction. Blockade latch 20 in trip unit 10 can rotate to permit tripping when current is flowing through current leading elements 12 and 14 in a predefined reverse direction, or when no current is flowing through current leading elements 12 and 14.

Current leading elements 12, 14 are surrounded by two magnetic yokes 16, 18. A single current leading element can be used, as well, or more than two current leading elements could be used. The flow of electrical current through current leading elements 12, 14 generates a magnetic flux or current that is directed through magnetic yokes 16, 18. The stronger the current flowing through current leading elements 12, 14, the stronger the magnetic flux flowing through magnetic yokes 16, 18.

The magnetic flux flowing through magnetic yoke 16 alters the position of a blockade latch 20 as magnetic flux is directed through an oscillator housing 22 and oscillator 23 housed inside. In an exemplary embodiment, oscillator 23, which emits a magnetic field, is rotated as magnetic flux flows through magnetic yoke 16 and oscillator 23.

Rotation of oscillator 23 causes rotation of blockade latch 20, as the two components are linked. Rotation of blockade latch 20 by oscillator 23 causes blockade latch 20 to pivot under a plate 24 into either a blocked or an unblocked position. Blockade latch 20 is in an unblocking position when blockade latch is under a recess 26. Blockade latch 20 remains in the unblocking position by resistance from spring 27, until sufficient magnetic flux acting on armature 23 causes it to shift positions. Blockade latch 20 is considered to be in a blocking position when blockade latch 20 is under a bumper 30.

Figure 2:
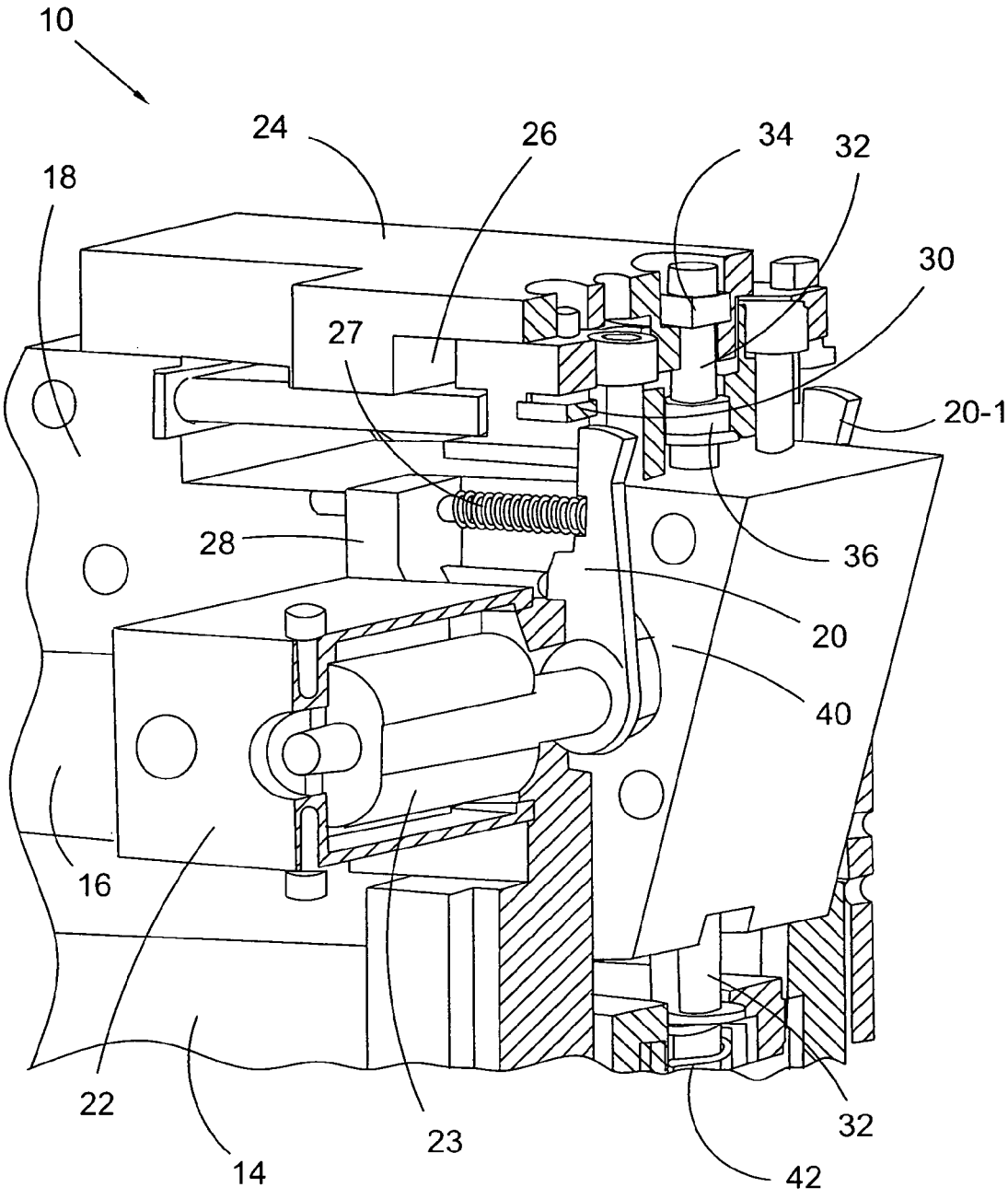
FIG. 2 is a perspective view of a partial cross section of the trip unit of FIG. 1.

Referring now to FIG. 2, lead rod 32 is mounted within trip unit 10. Lead rod 32 is a linear rod that is positioned perpendicular to plate 24 and attached to plate 24 with securing elements 34 and 36, but any known attachment means can be used. Leading rod 32 is also attached to the base of trip unit 10 with any known attachment means. Therefore, lead rod 32 is mounted in the interior of trip unit 10, attached proximate the top of trip unit 10 (proximate plate 24) and attached proximate the base of trip unit 10.

Slidingly attached to lead rod 32 is a movable anchor 40. Lead rod 32 is inserted through a bore proximate the center of anchor 40, and anchor 40 slides up and down on the axis provided by lead rod 32 when it is acted upon by magnetic yoke 18. Thus, anchor 40 is slidable upon the center axis created by lead rod 32.

At the base of anchor 40 is a spring 42 that resists downward movement of anchor 40. A certain force exerted by spring 42 must be overcome to enable anchor 40 to move downward. As electric current flows through current lead elements 12, 14 a magnetic flux is created that attracts anchor 40 downward against spring 42. Attraction of anchor 40 downward by magnetic flux flowing through magnetic yoke 18 causes tripping of trip unit 10. The strength of electric current flowing through current leading elements 12, 14 determines the strength of magnetic flux flowing through magnetic yoke 18 and the potential for tripping of trip unit 10. Also, the ability of trip unit 10 to trip is dependent on the positioning of oscillator 23 and blocking latch 20.

Bumper 30 is disposed on anchor 40, and as previously described, bumper 30 is the element that contacts blockade latch 20 when blockade latch 20 is in the blocking position. Attempts by anchor 40 to move downward will be prevented by bumper 30 on anchor 40 interacting with blockade 20 in the blocking position, i.e., under bumper 30.

Trip unit 10 can include a second symmetrically placed blockade latch 20-1 positioned on the other side of trip unit 10, opposite blockade latch 20. Including a second blockade latch 20-1 on the opposite side of blockade latch 20 enables the better blocking of anchor 40. A second bumper (not shown), similar to bumper 30, placed on the opposite side of bumper 30, would enable blockade 20-1 to assist in blocking anchor 40 from moving downward. Blockade latch 20-1 would also be joined to oscillator 23 and would respond simultaneously with blockade 20 and oscillator 23 as they both rotate.

Magnetic yoke 16 can effect the positioning of blockade latch 20 and oscillator 23 within oscillator housing 22. More specifically, magnetic flux generated from electrical current flowing through current leading elements 12, 14 affects the position of oscillator 23 and blockade latch 20, i.e., electric current flowing through current leading elements 12, 14 generates a magnetic flux that changes the position of oscillator 23.

Blockade latch 20 is joined to an oscillator 23, which oscillates between a blocking and an unblocking position depending on the direction of magnetic flux flowing through magnetic yoke 16 and oscillator 23. The direction and strength of electric current flowing through current leading elements 12, 14 determines the direction of magnetic flux flowing through magnetic yoke 16 and oscillator 23. Oscillator 23 changes position from blocked to unblocked by rotating within oscillator housing 22 around an axis 23 as the magnet field generated by oscillator 23 is confronted by the magnetic flux flowing through magnetic yoke 16. In response to the magnetic flux flowing through magnetic yoke 16, which flows perpendicular a magnetic field emitted from oscillator 23, oscillator 23 rotates slightly into either a blocking or an unblocking position depending on the direction of the magnetic flux flowing through magnetic yoke 16.

Magnets 44 on the interior of oscillator 23 can be positioned on both ends of oscillator 23 in order to enable oscillator 23 to emit a magnetic field. In other embodiments a single magnetic can be positioned within oscillator 23, or oscillator 23 can be magnetized. In some embodiments, magnets 44 are permanent or electromagnetic magnets.

Magnets 44 are acted upon by magnetic flux 48 flowing through magnetic yoke 16 and oscillator 23. As magnetic flux 48 flows through oscillator 23, magnetic flux 48 interacts with the magnetic current originating from magnets 44, the direction of the magnetic flux flowing through magnetic yoke 16 will cause oscillator 23 to rotate into a blocking or unblocking position. The direction of the magnetic flux 48 flowing through oscillator 23 will determine the direction that oscillator 23 will rotate. If no current is flowing through current leading elements 12, 14, then no magnetic flux is generated and oscillator 23 and blocking latch 20 will remain in the resting position shown in FIG. 3.

Oscillator 23 and blockade latch 20 are held in the resting position by spring 27. One side of spring 27 is held within a notch on a side of blockade latch 20 and the other end of spring 27 is held in place on wall 28. The potential energy of spring 27 prevents blockade latch 20 from moving into the blocking position without magnetic flux sufficient to overcome the potential energy of spring 27.

Figure 5:
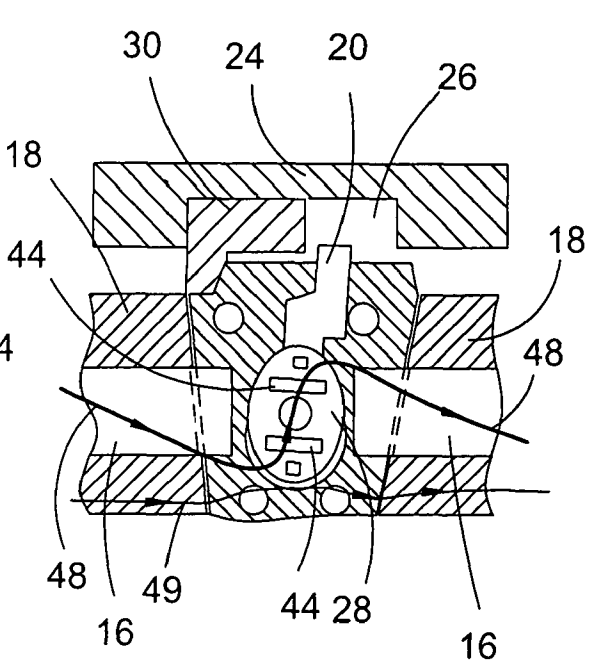
FIG. 5 is a sectional view, taken generally along line 2-2, of the trip unit of FIG. 1 with reverse flowing current.
Figure 4:
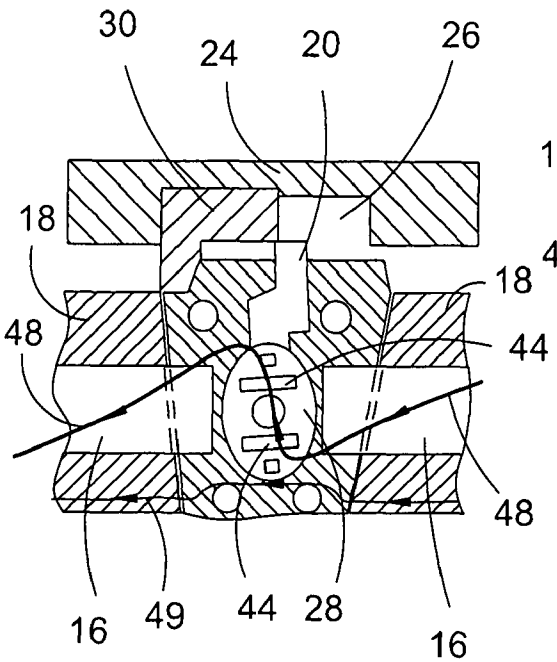
FIG. 4 is a cross-sectional view, taken generally along line 2-2, of the trip unit of FIG. 1 with forward flowing current.
Figure 3:
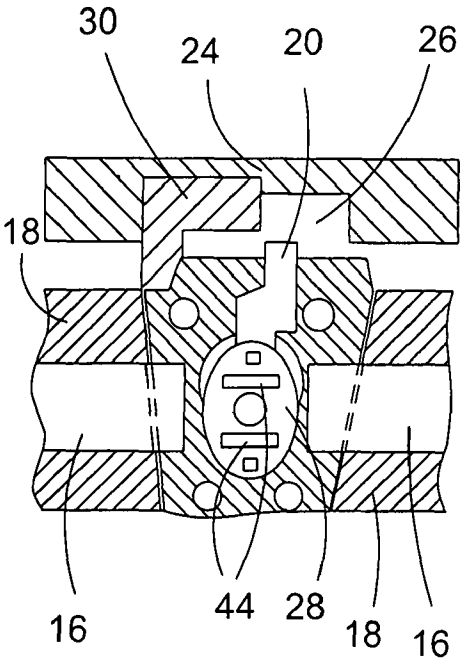
FIG. 3 is a cross-sectional view, taken along line 2-2, of the trip unit of FIG. 1 with no current.

FIGS. 3-5 are sectional views of trip unit 10 that show the different positions of oscillator 23 and blocking latch 20 as magnetic flux 48 flows through magnetic yoke 16. As previously noted, blockade latch 20 is linked to oscillator 23 and rotation of oscillator 23 leads to the rotation of blockade latch 20. Electric current flowing through current leading elements 12, 14 generates a magnetic flux 48 that flows through magnetic yoke 16 and causes rotation of oscillator 23.

Oscillator 23 is shown having a generally oval shaped profile, but this exemplary embodiment is only one potential shape for oscillator 23. Oscillator 23 can be other shapes that permit oscillator movement as a result of a magnetic force. For example, oscillator 23 could be round or have rounded ends to permit rotation.

In other embodiments, oscillator 23 can be a non-rounded shape, such as a rectangle. If oscillator 23 is a non-rounded shape the oscillator would be unable to rotate and oscillator 23 would need to function in an alternative method. Instead of rotating oscillator 23, it could move linearly, sliding blockade latch 20 into and out of a blocking position. Oscillator 23 would slide blockade latch 20 into either a blocking position under bumper 30, or an unblocking position under recess 26 as magnetic flux affected oscillator 23.

In other embodiments, the axis and position of oscillator 23 and blockade latch 20 can be changed from the arrangement described in this disclosure and such changes would be considered within the spirit and scope of the disclosure. For example, oscillator 23 can rotate on an axis perpendicular to axis 23.

FIG. 3 shows the position of bumper 30, oscillator 23 and blockade latch 20 when trip unit 10 has no current flowing through current leading elements 12, 14. In this state oscillator 23 and blockade latch 20 are in an unblocking position and anchor 40 and bumper 30 are free to move downward, i.e., trip unit 10 is ready to trip. Since current is not flowing through current leading members 12, 14, no magnetic flux is generated and oscillator 23 does not rotate from its resting position.

FIG. 4 shows the position of bumper 30, oscillator 23 and blockade latch 20 when trip unit 10 has forward current flowing through current leading elements 12, 14. In this state oscillator 23 and blockade latch 20 are in a blocking position and anchor 40 and bumper 30 are blocked from moving downward, i.e., trip unit 10 is unable to trip. Thus, electric current flowing through trip unit 10 in a predefined forward direction will be unable to trip due to blockade latch 20 preventing anchor 40 from moving into the tripped position. This is due to magnetic flux 48 moving oscillator 23 and blockade 20 into a blocking position. Contact between bumper 30 and blockade 20 prevents anchor 40 from moving downward and tripping.

FIG. 5 shows the position of bumper 30, oscillator 23 and blockade latch 20 when trip unit 10 has reverse current flowing through current leading elements 12, 14. In this state oscillator 23 and blockade latch 20 are in an unblocking position and anchor 40 and bumper 30 have already moved downward, i.e., trip unit 10 is just tripped. Thus, electric current flowing through trip unit 10 in a predefined reverse direction does will be capable of tripping due to the position of blockade latch 20 under recess, which will enable anchor to move into the tripped position. This is due to magnetic flux 48 moving oscillator 23 and blockade 20 into an unblocking position. Blockade 20 is in a position under recess 26 and anchor 40 is free to move downward and trip. The capability of trip unit 10 to allow electric current to flow in one direction and to prevent electric current to flow in another direction enables trip unit 10 to function as trip unit of rectifier breaker, to protect a rectifier.

Trip unit 10 has been described as having magnetic yoke 16 to direct magnetic flux 48 to flow through oscillator 23 to change the position of blockade latch 20, and magnetic yoke 18 to direct magnetic flux 49 (separate number required for flux in yoke 18, e.g. 49) to flow through anchor 40 to cause tripping. In other embodiments, the task of magnetic yokes 16, 18 can be consolidated into a single magnetic yoke (not shown). A single magnetic yoke would function similarly to the dual yoke embodiment, changing the positioning of anchor 40, and changing the positioning of oscillator 23 with magnetic flux.

The particular type, including materials, dimensions and shape, of the various components of trip unit 10 that are utilized can vary according to the particular needs of trip unit 10.

It should also be noted that the terms "first", "second", "third", "upper", "lower", and the like may be used herein to modify various elements. These modifiers do not imply a spatial, sequential, or hierarchical order to the modified elements unless specifically stated.

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out the elements of this disclosure, but that the disclosure will include all embodiments falling within the scope of the appended claims.

What is claimed is:

1. A trip unit, comprising:

a movable anchor having a tripped position and an untripped position;

an oscillator having a first and second position, wherein in said first position said oscillator allows said anchor to move into said tripped position, and in said second position said oscillator prevents said anchor from moving into said tripped position;

a magnetic yoke surrounding said movable anchor and said oscillator, wherein said magnetic yoke provides a magnetic current to move said movable anchor into said tripped position, and said magnetic yoke provides a magnetic current to move said oscillator into said first or second positions; and a current carrying element surrounded by said magnetic yoke, wherein said current carrying element generates said magnetic current perpendicular to an electric current conducted through said current carrying element, wherein said electric current conducted through said current carrying element in a forward direction positions said oscillator in said second position, and said electric current conducted through said current carrying element in a reverse direction positions said oscillator in said first position.

2. The trip unit of claim 1, wherein said oscillator further comprises a magnet.

3. The trip unit of claim 1, wherein said oscillator rotates into either said first position or said second position when acted upon by said magnetic current.

4. A trip unit, comprising:

a current carrying element;

an oscillator having a first position and a second position;

an anchor having a tripped position and an untripped position;

a first magnetic yoke surrounding said current carrying element and said anchor, wherein a first magnetic flux flowing through said first magnetic yoke moves said anchor into said tripped position; and a second magnetic yoke surrounding said current carrying element and said oscillator, wherein a second magnetic flux flowing through said second magnetic yoke moves said oscillator into said first position or into said second position.

5. The trip unit of claim 4, wherein when said oscillator is in said first position said anchor is permitted to move into said tripped position, and when said oscillator is in said second position said anchor is blocked from moving into said tripped position.

6. The trip unit of claim 5, wherein said oscillator rotates into said first position and second position.

7. The trip unit of claim 5, further comprising a blockade latch connected to said oscillator, wherein said blockade latch interacts with said anchor to prevent downward movement of said anchor.

8. The trip unit of claim 4, wherein said oscillator emits a magnetic field and said second magnetic flux moves said oscillator into said first or second position by interacting with said magnetic field.

9. The trip unit of claim 4, wherein said oscillator further comprises a magnet that emits said magnetic field.

10. The trip unit of claim 4, wherein electrical current is conducted through said current carrying element.

11. The trip unit of claim 10, wherein said electrical current generates said first and second magnetic flux.

12. The trip unit of claim 10, wherein electrical current in a forward direction generates a second magnetic flux that moves said oscillator into said second position.

13. A trip unit, comprising:

a current carrying element;

an anchor having an up position and a down position;

an oscillator having a first position and a second position, wherein when said oscillator is in said first position said anchor is permitted to move into said down position, and when said oscillator is in said second position said anchor is blocked from moving into said down position;

at least one magnetic yoke surrounding said current carrying element, said anchor, and said oscillator, wherein said at least one magnetic yoke provides a magnetic current to move said movable anchor into said down position, and said at least one magnetic yoke provides a magnetic current to move said oscillator into said first or second positions;

a blockade latch connected to said oscillator, wherein said blockade latch interacts with said anchor to prevent downward movement of said anchor; and a bumper, wherein said bumper is disposed about said anchor and is contacted by said blockade latch to prevent downward movement of said anchor, wherein said at least one magnetic yoke comprises a first magnetic yoke surrounding said current carrying element and said anchor and a second magnetic yoke surrounding said current carrying element and said oscillator.

14. The trip unit of claim 13, further comprising a spring positioned to resist downward movement of said anchor.

15. The trip unit of claim 13, wherein said first magnetic yoke has a first magnetic flux flowing therethrough to move said anchor into said down position.

16. The trip unit of claim 13, wherein said second magnetic yoke has a second magnetic flux flowing therethrough to move said oscillator into said first position or into said second position.

17. The trip unit of claim 2, wherein said magnet is on an interior of said oscillator.

* * * * *